US005086590A

United States Patent [19]

Athanasiou

[11] Patent Number: 5,086,590

[45] Date of Patent: Feb. 11, 1992

[54] TOOL CHECKING DEVICE FOR USE WITH NUMERICALLY CONTROLLED MACHINES

[76] Inventor: George Athanasiou, 3110 Spring St., Redwood City, Calif. 94063

[21] Appl. No.: 367,421

[22] Filed: Jun. 16, 1989

[51] Int. Cl.[5] ..... B24B 49/00

[52] U.S. Cl. ..... 51/165.71; 51/165.74; 51/165.87; 408/6; 408/8; 408/11; 408/16

[58] Field of Search ..... 51/165 R, 165.71, 165.74, 51/165.75, 165.87, 165.88; 408/6, 8, 11, 16; 409/134, 218; 364/474.37, 474.35, 474.21, 474.17

[56] References Cited

U.S. PATENT DOCUMENTS 4,571,892 2/1986 Brill ..... 51/165.88

4,718,175 1/1988 Babel ..... 408/6

*Primary Examiner*—M. Rachuba

*Attorney, Agent, or Firm*—Robert A. Seldon

[57] ABSTRACT

A sensing assembly is provided which, by utilizing the CNC machine's M-codes, is adapted to be retrofitted to existing numerical control machines for detecting the excessive wear, chipping, breaking or mislocation of the cutting tool and shutting down the CNC machining operation in response.

7 Claims, 1 Drawing Sheet

TOOL CHECKING DEVICE FOR USE WITH NUMERICALLY CONTROLLED MACHINES

This invention relates to numerically controlled machines which against a workpiece, and more specifically to a sensing apparatus and method for stopping the machining process in response to the condition of the work tool.

Computer numerically controlled (CNC) machines are well known industrial machines which operate under computer or microprocessor control to carry out a sequence of machining operations on a workpiece in accordance with programmed instructions. Typically, the machining, operations include drilling, milling, turning, boring, grinding, tapping, threading and other forms of cutting wherein a work tool is moved against a workpiece to remove material from the workpiece.

As is known to those skilled in the art, the average numerically controlled machine includes a array of different types and sizes of tools stored within the machine and from which a sequence of appropriate tools are selectively retrieved in accordance with programmed instructions. Operating under such instructions, the CNC machine positions the tool holder at the correct location with respect to the workpiece, and rotates or otherwise moves the worktool with respect to the workpiece (or the workpiece with respect to the tool). After a machining operation with one selected tool on one or more workpieces has been completed, the next tool is selected, and the next machining operation is commenced.

In the course of the machining operation, worktools are subject to wear, chipping and breaking as they operate on the workpiece. Unless a worn or damaged tool is detected, it may be repeatedly used on the workpiece, and on subsequent workpieces, with consequential and irreparable damage. Simiarly, the tools which follow the worn or damaged tool may be broken due to the presence of material on the workpiece which would normally have been removed. Since the primary advantage of an CNC machine is the elimination of constant monitoring by personnel during the machining of the workpieces, a broken or chipped tool can easily convert a large number of expensive workpieces into scrap when the condition is not detected for some time.

In addition to wearing, chipping and breaking, a tool can become axially mislocated within the tool holder. Typically, this type of mislocation results from a "corkscrew" effect that can occur when the tool slips within the tool holder as it cuts the workpiece. The consequences of such mislocations include holes and cuts of improper depth, as well as damage caused by the jamming of the overly extended tool into the workpiece when the CNC machine brings the tool holder to the programmed coordinates, and the effects of any consequential tool breakage.

In the past, the occurrences of chipped and broken tools have been minimized by replacing the tools well before the end of their actual life expectancies. In addition, such machining operations have tended to be relatively closely watched to ensure that premature chipping and breakage did not occur. Even then, some chippage escapes undetected, degrading the efficiency of the process and/or the quality of the machining operation, and the resulting number of scrapped workpieces have been simply accepted as inevitable.

The invention herein involves the use of "M-codes" and the like to sense tool wear, chipping and breakage in order to interrupt the machining process and minimize such scrapping and reworking of workpieces. M-Codes and the like are supplied by the manufacturers of CNC machines as pre-defined codes by which the user can connect other equipment to accessible electrical terminals on the CNC machine, and program the CNC machine to use that equipment at user-defined points in the sequence of machining operations. Although their name may vary from manufacturer to manufacturer, the term "M-code" will be used herein, and will be understood by those skilled in the art.

The various external M-codes, and their effect on the numerical control machine, are typically provided to the user as part of the documentation that accompanies the machine. One type of M-code, for example, causes a state change at one set of operator-accessible terminals and prevents the CNC machine from proceeding to its next program step until a switch is closed across another set of operator-accessible terminals. Typically, the external M-codes are used to operate air blowers, utilize a different coolant on a work tool during a particular machining operation, rotate the workpiece about an additional axis, signal a robot, etc.

In accordance with the invention, a sensing assembly is provided which, by utilizing the CNC machine's M-codes, is adapted to be retrofitted to existing numerical control machines for detecting the excessive wear, chipping, breaking or mislocation of the cutting tool and shutting down the CNC machining operation in response. As discussed in detail below, the sensor assembly utilizes common electrical signals which are typically made available to the user by the CNC machine's manufacturer for other purposes, and thereby eliminates the need to internally modify the existing machine.

The numerically controlled machine includes tool holder means for releasably securing an axially extending tool and for moving the axially distal cutting surface of the tool against the workpiece to remove material therefrom;

programmable control means responsive to a sequence of programmed instructions for successively positioning the tool holder with respect to the workpiece and controllably moving the tool against the workpiece during each of a succession of machining operations;

means responsive to programmed instructions for producing an operator-accessible electrical signal, and for thereafter interrupting the programmed sequence until receipt of an enabling signal; and operator-accessible means for coupling the enabling signal to the instruction-responsive means to initiating the next instruction in said succession.

Accordingly, the sensor assembly comprises first switch means respectively coupled to the numerical control machine in circuit to selectively apply the enabling signal to the operator-accessible means, the first switch means being mounted with respect to the numerical control machine to selectively apply said signal to said operator-accessible means only if the axial length of the tool is greater than a minimally acceptable length.

In the preferred embodiment, the sensor includes an axially movable plunger positioned for contact by the axially distal end of the tool after a machining operation, the first switch means is responsive to a predetermined amount of the vertical movement of the plunger to couple the enabling signal to the operator-accessible means, and the control means is programmed to move the tool holder means after a machining operation to a predetermined position spaced from the plunger means by a minimally acceptable tool length.

These and other features of the invention are explained in greater detail in the following description of the preferred embodiment, of which the Drawing is apart.

DESCRIPTION OF THE PREFERRED EMBODIMENT

Figure 1:
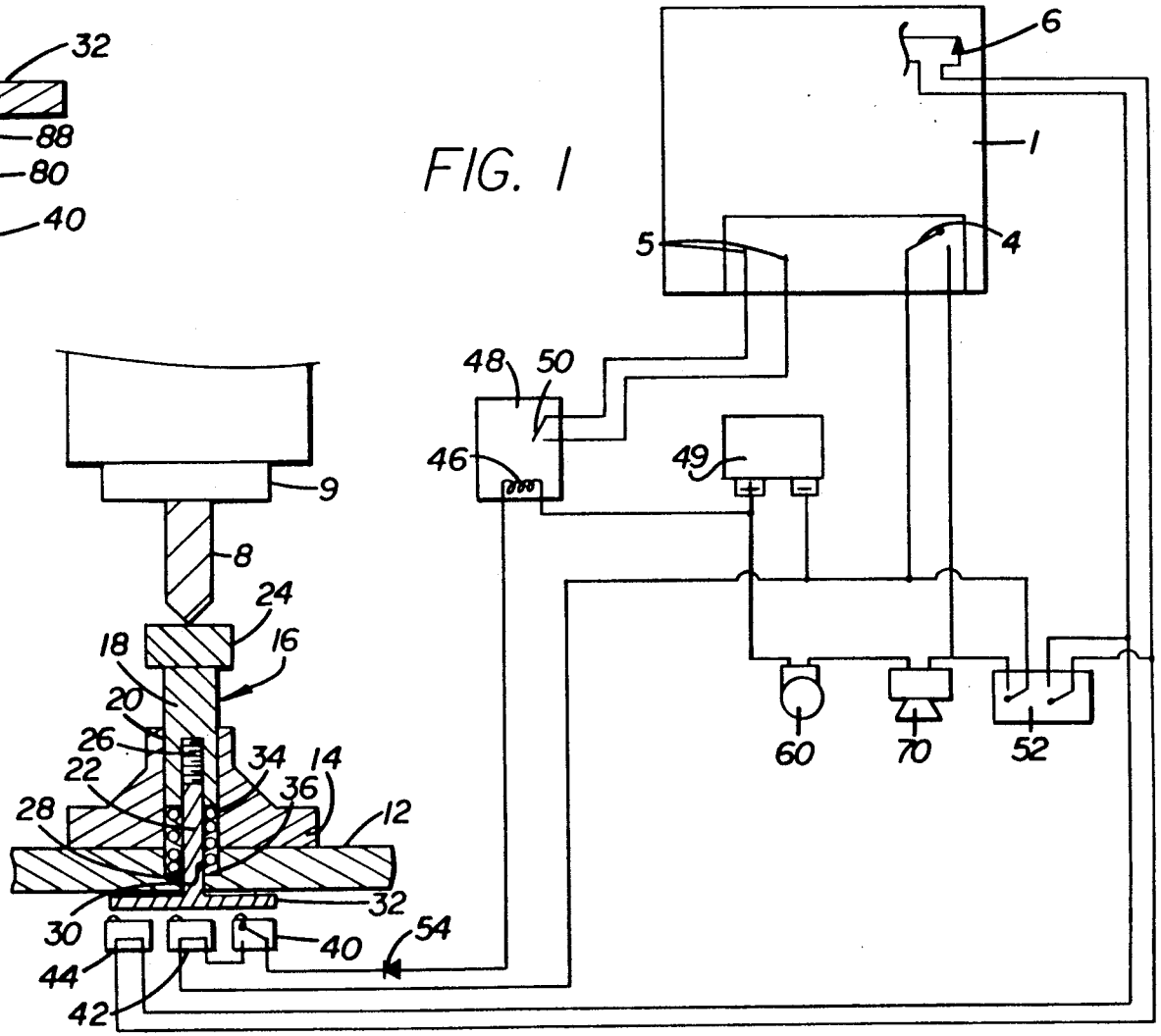
FIG. 1 is a sectional view of a sensor assembly constructed in accordance with the invention and includes a schematic illustration showing the assembly electrically coupled to a numerical control machine.

A sensor assembly, generally illustrated at 10, is shown in FIG. 1 juxtaposed with a worktool 8 that is mounted within a tool holder 9 of a numerical control machine. The numerical control machine is schematically illustrated as also including a controller or microprocessor 7 having an emergency stop switch 6 and two pair of control terminals 4, 5 respectively. As explained below, the terminals 4,5 are a dedicated pair of M-code terminal pairs which are selected by a single M-code. That single M-code creates a condition at terminals 4, and interrupts the machining operation until an externally-generated signal is applied to terminals 5. The terminals 4, 5 are typically provided by the manufacturer of the numerical control machine in a user-accessible location so that the user can connect other equipment to the machine and program the machine to use that equipment at a user-defined point in the sequence of machining operations.

The user typically encodes the use of the external equipment into the program by means of "external M-codes" or other equivalent machine instructions. The various external M-codes, and their effect on the numerical control machine, are typically pre-defined by the manufacturer of the CNC machine and are provided to the user as part of the documentation that accompanies the machine. One type of M-code causes a state change at one set of operator-accessible terminals and prevents the machine from proceeding to its next program step until a switch is closed across another set of operator accessible terminals. Typically, the external M-codes are used to operate air blowers, utilize a different coolant on a work tool during a particular machining operation, rotate the workpiece about an additional axis, signal a robot, etc.

In the illustrated embodiment, the M-code is selected which causes an internal switch closure between terminal pair 4 and an interruption in the execution of the programmed instructions until an external switch closure takes place across terminal pair 5. My CNC machine is an Okuma MC4VA, wherein the M-codes 181, 182, 183 or 184 can be used depending on the particular terminal pairs that one wishes to use as the terminals 4, 5. Each of the preceding M-codes creates, and is responsive to, a switch state at a different set of terminal pairs as set forth in the user's manual which accompanies the machine.

The sensor assembly 10, that will now be described, is responsive to the length of the worktool 9 to provide an external switch state at terminals 5 that interrupts the machining process unless the tool length is within acceptable pre-defined limits. If the length is too short (indicating impermissible wear, chipping or breakage of the tool) or too long (indicating that the tool may have slipped within the tool holder), the operation of the machine is interrupted, and a visual and/or audible alarm triggered, until the condition is attended to by the machine's operator. As discussed below, the "envelope" of acceptable tool lengths will permit the process to continue can typically be 0.007 inches (0.2 mm).

The sensor assembly 10 includes a housing (of which only the top surface 12 is shown), a generally tubular stainless steel sleeve 14 secured to the top surface of the housing, and a plunger 16. The plunger 16 is formed from a body of hardened steel and has a generally "T"-shaped longitudinal section. The axially-extending, generally cylindrical stem portion 18 of the plunger 16 extends through the bore 20 of the sleeve 14 to engage an actuating member 22 in the housing. A relatively wider head portion 24 of the plunger is positioned for contact with, and axially-directed displacement by, the tool 8 as discussed below. Naturally, the plunger mechanism 16 and sleeve 14 may be of any of a number of shapes, and can be formed from any of a number of suitable materials.

The longitudinal section of the actuating member 22 is an inverted "T". Its stem portion 26 extends upward through an aperture 28 in the top surface of the housing, through the internal bore 20 of the sleeve 14, and into an internally threaded, axially extending bore 30 in the plunger's stem 18. The stem 26 of the actuating element 22 is externally threaded to mate with internal screw threads in the plunger's bore 30, thereby coupling the actuating element to the plunger 16 for corresponding axial movement. During assembly of the sensor, the sleeve 14 and plunger 16 are accordingly mounted on the housing over the aperture 28, and the threaded stem of the actuating member is threaded into the plunger's bore by relative rotation therebetween.

The head portion 32 of the actuating member is resiliently retained in contact with the interior of the upper wall of the housing by a spring 34 that is captured in compression between the housing 12 and the end of the plunger's stem, exerting an upward force against the distal end 16*a* of the plunger 16. The spring 34 circumvents the upwardly-extending stem 26 of the actuating member 22, with one end of the spring butting against the distal end of the plunger. The other end of the spring is accommodated within a counterbore 36 that is formed in the top of the housing's surface co-axially with the aperture 28, and butts against a shoulder formed where the counterbore interfaces with the aperture.

In the reference position maintained by the spring, the head 32 of the actuating element 22 is positioned between the housing surface and the actuating members of three switches 40, 42, 44. Switch 40 is a normally open device serially coupled in electrical circuit between normally closed switch 42 and one end of the coil 46 of a normally open, flasher-type relay 48. The other end of the relay coil 46 is coupled to the positive terminal of a 24 volt power supply 49. The normally open contacts 50 of the relay 48 are respectively coupled to the terminals 5 of the CNC machine's controller or microprocessor that are provided by the machine's manufacturer at a user-accessible location for receipt of the switch closure that enables the CNC to sequence to the next programmed step.

In operation, the CNC machine is programmed to position the worktool against the plunger 16 after each machining operation, or as many times a desired during the tool's cycle. For example, if 30 parts are being machined with the same tool, the tool can conveniently be checked after every 5 parts are machined. Accordingly, the worktool is moved to a position over the plunger, and brought down axially to a pre-programmed position that was determined in accordance with the length of the tool when it was new. Unless the tool has been unacceptably worn, chipped or broken, the distal end of the tool will cause sufficient downward displacement of the plunger to trip switch 40.

Naturally, the pre-programmed position may, if desirable, take into account, any wear allowance which the user wishes to discount. For example, it may be desirable to trip switch 40 even though the bit may have worn down by as much as 0.002 inches, in which case, the CNC machine is programmed to position the tool holder above the plunger by an amount equal to the tool length minus 0.002 inches.

The next program step contains the M-code which closes switch 4, completing an electrical circuit that couples the power supply 49 to an alarm light 60 and an audible alarm 70 which will notify the operator that the machine's operation has been interrupted. If, however, the tool 8 is of acceptable length, the alarm circuit will be deactivated before the alarm can sound.

If the tool 8 is of acceptable length, switch 40 is closed, completing an electrical circuit through normally closed switch 42, the power supply, and the relay coil 46. The relay contacts 50 accordingly close and open, providing the current pulse to terminals 5 which opens switch 4 and causes the program to sequence to the next step.

In the event that the tool 8 has slipped within the tool holde its length will be longer than the permissible limit, and the excessive downward offset of the plunger will close switch 40 but open switch 42, thereby preventing the relay coil from closing the contacts 50. Consequently, the alarm circuit will remain activated, and the machining operation will be interrupted until the operator investigates and remedies the problem.

Since the machine operator is assured that any instance of breaking, chipping or unacceptable wear will interrupt the machine's cycle, the machine can be operated with less monitoring and with a lower scrap rate or rework rate due to tool wear or breakage.

Another aspect of the invention herein relates to the high degree of accuracy with which the sensor can be used for setting tool length offsets. Since tool length varies from tool to tool, the tool holder may be at any of a variety of distances from the workpiece when the tool is touching the workpiece. In order to compensate for that variable distance, the CNC machine can be offset to shift its reference axis by an amount specific to each tool, so that the machine operator can bring the tool to the top of the workpiece without having to take the different tool lengths into consideration in the program.

In accordance with the invention, the operator can position the tool on the plunger, and depress the plunger until an LED 54 in electrical series with the switch 40, lights, indicating that the switch 40 is closed. The operator then enters the height displayed by the CNC machine's screen into the controller as the length offset for that tool, and repeats the procedure for each tool in the machine's array of tools.

To reduce the risk of breaking tools or damaging the machine when setting tool heights, switch 44 is included in the housing 12 for actuation by the member 32. Switch 44 is a normally closed, emergency stop switch mounted in electrical series with the machine's emergency switch 6. The switch 44 is opened by the actuator element's head 32 if the plunger is depressed even more than is necessary to open switch 42, stopping the CNC machine in the same way as the main switch 6.

Figure 2:
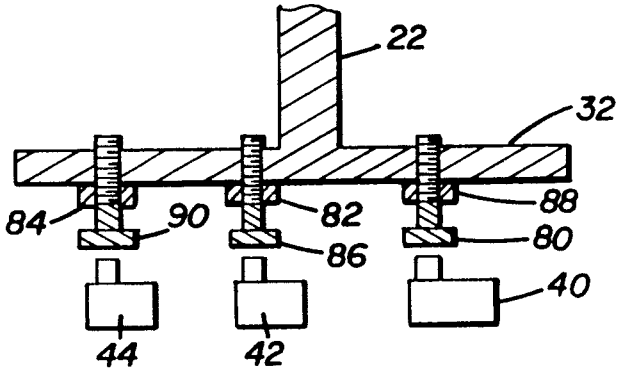
FIG. 2 is an enlarged fragmentary sectional view of the actuating element illustrated in FIG. 1.

In practice, switch 40 can be actuated by 0.005 inches of plunger movement, and switch 42 by an additional 0.007 inches, providing a 0.007 inch envelope of acceptable tool length. sealed switches such as Burges CV4S switches have proven satisfactory for use as switches 40, 42, 44. The point at which each switch is actuated by the member 22 can be precisely adjusted in a variety of ways. As shown in FIG. 2, that adjustment is preferably provided by three 40-pitch machine screws 80, 82, 84 tightened into an respective internally threaded holes in the actuating member's head 32, which are positioned above the actuating member of each switch 40, 42, 44. Each screw moves axially by 0.025 inches/revolution, yielding a precise means for setting and changing the acceptable limits of tool length. The screws 80, 82, 84 are firmly held in position by respective nuts 86, 88, 90 which subject the screws in a manner known in the art to outward axial pressure that prevents self-rotation. In addition, lock washers may be used if desired.

While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

I claim:

1. For use with a numerically controlled machine of the type which is programmable to carry out a succession of machining operations on a workpiece, and including means for supporting a workpiece, tool holder means for releasably securing a worktool and for moving the axially distal portion of said tool against the workpiece to remove material therefrom;

programmable control means responsive to a sequence of programmed instructions for successively positioning the tool holder means with respect to the workpiece and controllably moving the tool against the workpiece during each of a succession of machining operations, first and second sets of operator-accessible terminal means positioned on the numerically controlled machine for connection to external equipment, and instruction-responsive means responsive to programmed instructions for producing an operator-accessible signal at the first set of operator-accessible terminal means, and for interrupting the programmed sequence until receipt of an enabling signal, the second set of operator-accessible terminal means coupling the enabling signal to the instruction-responsive means to initiate the next instruction in said succession;

a retrofit sensor assembly for detecting unacceptable tool length and comprising:

first switch means coupled to the first set of terminal means to selectively apply the enabling signal to the second set of terminal means, the first switch means being mounted with respect to the numerical control machine to selectively apply said enabling signal to said second set of terminal means only if the axial length of the tool is greater than a minimally acceptable length.

2. The sensor of claim 1 wherein the sensor includes an axially movable plunger positioned for contact by the axially distal end of the tool after a machining operation, an axially movable plunger positioned for contact by the axially distal end of the tool after a machining operation, the first switch means is responsive to a predetermined amount of the vertical movement of the plunger to couple the enabling signal to the second set of terminal means, and the control means is programmed to move the tool holder means after a machining operation to a predetermined position spaced from the plunger means by a minimally acceptable tool length.

3. The sensor assembly of claim 2 including second switch means responsive to the plunger movement for preventing the electrical coupling of the power supply means and the signal-responsive means unless the detected axial length of the tool is less than a predetermined maximum.

4. The sensor assembly of claim 3 wherein the second switch means is coupled in electrical series with the first switch means.

5. The sensor assembly of claim 3, including spring means for biasing said plunger towards an initial position in opposition to the tool-induced movement, the first and second switch means having respective physically movable actuator elements, the plunger including first and second contact surfaces for moving said actuator elements upon respectively sufficient displacement of the plunger by the tool.

6. The sensor assembly of claim 1 including second switch means for preventing the electrical coupling of the power supply means and the signal-responsive means unless the detected axial length of the tool is less than a predetermined maximum.

7. The sensor assembly of claim 6, wherein the second switch means is coupled in electrical series with the first switch means.

* * * * *